United States Patent [19]

Plowman et al.

[11] Patent Number: 4,524,816

[45] Date of Patent: Jun. 25, 1985

[54] CENTRIFUGAL CASTING FURNACE

[75] Inventors: Richard E. Plowman, York; James A. VanLenten, Lancaster, both of Pa.

[73] Assignee: Dentsply Research & Development Corp., Milford, Del.

[21] Appl. No.: 581,984

[22] Filed: Feb. 21, 1984

[51] Int. Cl.[3] ..... B22D 13/06; B22D 13/10

[52] U.S. Cl. ..... 164/287; 164/289; 164/292

[58] Field of Search ..... 164/286, 287, 288, 289, 164/290, 291, 292, 293, 294, 295, 296, 297; 73/1 DC

[56] References Cited

U.S. PATENT DOCUMENTS

| | | | |
|---|---|---|---|
| 1,563,151 | 11/1925 | Booth | 164/287 |
| 2,011,955 | 8/1935 | Touceda | 164/289 X |
| 2,192,043 | 2/1940 | Hooper | 164/289 |
| 2,235,443 | 3/1941 | Steinbock et al. | 164/289 |
| 2,265,043 | 12/1941 | Moore | 164/287 |
| 2,338,560 | 1/1944 | Yaruss | 164/289 |
| 2,375,463 | 5/1945 | Berger | 164/287 X |
| 2,465,819 | 3/1949 | Rubissow | 164/289 |
| 2,749,585 | 6/1956 | Prosen | 164/514 |
| 2,752,650 | 7/1956 | Bosna | 164/287 |
| 3,180,131 | 4/1965 | Thompson | 73/1 DC |
| 4,063,863 | 12/1977 | Hilmoe | 164/289 X |
| 4,077,460 | 3/1978 | Halatek | 164/152 |
| 4,134,445 | 1/1979 | Goodrich et al. | 164/287 |
| 4,280,551 | 7/1981 | Ohara | 164/287 |

*Primary Examiner*—Nicholas P. Godici
*Assistant Examiner*—Kenneth F. Berg
*Attorney, Agent, or Firm*—C. Hercus Just; Edward J. Hanson, Jr.

[57] ABSTRACT

A centrifugal ceramic casting furnace including a horizontal arm rotatably supported by the upper end of a vertical shaft driven by a motor and the arm having a casting ring cradle on one end, a muffle movable along said arm a limited distance toward and from the cradle and a counterweight device mounted upon the opposite end of the arm adjustably both longitudinally and upwardly in a manner to balance the opposite ends of the arm statically and also adjustably dispose the effective masses of the muffle and counterweight within a common horizontal plane to effect substantial freedom from vibration while the furnace is rotating at a centrifugal casting speed.

11 Claims, 7 Drawing Figures

CENTRIFUGAL CASTING FURNACE

BACKGROUND OF THE INVENTION

Centrifugal casting is a popular art that has been in existence for many years, especially in the jewelry industry, where, for example, by using the lost wax process, a simple mold can be made in plaster of Paris, or suitable gypsum products of industrial type. An ingot of precious metal or otherwise is placed in a muffle on one end of a horizontal rod mounted on the upper end of a vertical shaft which is rotated by any suitable motor. The muffle is usually electrically heated to melt the ingot and, when molten, it is introduced to the cavity in the mold and centrifical action insures full projection of the molten material into the mold and, when done expertly, no cavities or holes due to residual air occur in the finished product. The opposite end of the horizontal rod usually supports a counterweight to avoid the need of securely anchoring the rotatable shaft by suitably embedding the lower end thereof in a mass of heavy material such as Portland cement or otherwise.

Centrifugal casting such as that broadly described above also is employed in the dental art for purposes of making crowns, inlays, and certain other related types of metal items employed in restorative dentistry, the lost wax process also frequently being used to make the necessary mold in which cavities of desired shapes are formed. One simple form of casting metallic dental material to form a molded object is the subject matter of prior U.S. Pat. No. 1,563,151 to Booth, dated Nov. 24, 1925 and a later, more sophisticated machine of this broad type comprises the subject matter of prior U.S. Pat. No. 2,235,443 to Steinbock et al, dated Mar. 18, 1941, both of the aforementioned patents revolving the muffles in a vertical plane about a horizontal shaft and in both of these counterweights are employed on the end the rotatable arm or bar which is opposite the muffle.

Other forms of centrifugal casting machines for making cast dental objects and in which the arms that support the muffles and counter balances are disposed for operation about a vertical axis in a horizontal plane comprise the subject of prior U.S. Pat. Nos. 2,749,585 to Brosen, dated June 12, 1956; 4,077,060 to Halatek, dated Mar. 7, 1978; and 4,134,445 to Goodrich et al, dated Jan. 16, 1979, the examples of operation shown therein primarily employing counterweights in suitable arrangement so that vibration is minimized and comprise so called bench type centrifugal casting machines which do not require substantial anchoring because of the muffles and counterweights counterbalancing each other.

Still another prior U.S. Pat. No. 4,280,551 to Ohara, dated July 28, 1981 illustrates a somewhat more sophisticated type of centrifugal casting apparatus for dentistry in which the rotatable shaft for the transverse arm on one end thereof which carries the muffle and counterweight is disposed at an angle of substantially 45° to the horizontal.

The present invention also pertains to a centrifugal casting furnace, especially for dental purposes, which includes a transverse arm carried by the upper end of a vertical rotatable shaft and an electrically heated muffle is mounted adjacent one end of said arm, while a counterweight is carried by the opposite end of the arm, and is adjustable in certain ways that are distinct from the prior art and the invention also includes other beneficial and meritorious characteristics that likewise are not found in the prior art and especially the type of art referred to above. The present invention is especially directed to centrifugal ceramic casting furnaces for casting glass dental prosthetic parts. Details of such innovations and characteristics are set forth below.

SUMMARY OF THE INVENTION

It is among the principle objects of the invention to provide on one end of a rotatable transverse arm, a counterweight which is on the opposite end of the arm from that which supports the muffle and said counterweight is arranged to vertically adjust the mass of the same relative to the principle mass of the muffle in such manner that the counterweight and muffle are dynamically balanced in the static mode, as well as being balanced in the horizontal plane with respect to the upper end of the rotatable shaft, whereby substantial freedom from vibration is effected especially when the arm is rotated at casting speeds.

Ancillary to the foregoing object, it is a further object to produce counterbalancing of the muffle by means of a pair of relatively heavy circular weights, one of which is centrally bored and threaded, while a second one has a bore which is substantially offset to the center thereof and is threaded, both of said weights being adapted to be adjustably positioned on the end of the rotatable arm which is opposite that which has the muffle thereon and said arm preferably is tubular and threaded in order that the weights may be adjustably positioned on the arm by threadably moving the same as required to effect static balancing and by threadably moving the two weights into firm contact with each other, so that a lock-nut function is produced to maintain the weights in the desired position and in which the mass of the eccentric weight is uppermost to effect dynamic balancing of the muffle which is mounted on the opposite end of the arm above the upper surface thereof for purposes to be described hereinbelow.

A further object of the invention is to form the transverse arm from tubular stock for purposes of accomodating a longitudinally movable push rod which is slidable in the tubular arm, said arm also having longitudinally spaced slots respectively to accomodate a connection between one end of the push rod and the muffle and the other slot accomodates a manually operated handle connected to the opposite end of the push rod and extending through said other slot in the tubular arm in order that the muffle may be moved a limited extent longitudinally with respect to the end of the arm opposite the counterweights for purposes of positioning a casting ring on the rotatable arm outwardly from the outer end of the muffle and, to accomodate such casting ring, it is a further object of the invention to secure a substantially U-shaped cradle adjacent the terminal end of the arm on which the muffle is mounted and the sidewalls of the cradle being slotted upwardly for purposes of accomodating the ends of the tongs to facilitate positioning and removing casting rings within and from the cradle.

Still another object of the invention is to facilitate at least static balancing of the arm with respect to the upper end of the rotatable shaft that supports it by providing said upper end of the shaft with a transverse opening of larger vertical dimension than the diameter of the arm and positioning a fulcrum-type transverse pin which extends through said shaft partially above the lower surface of the transverse opening and the arm having a notch in the lower surface thereof seated upon said pin for static balancing of the arm by adjustment of the counterweight thereon relative to the muffle, the shaft also being threaded on its upper end to accomodate a clamping cap suitably upon said upper end and having a lower end clampingly interengageable with the upper surface of the arm to clamp the same firmly upon the transverse pin after static balancing has been completed.

Ancillary to the foregoing object, it is a still further object to employ a clamping cap which is cup-shaped and has a depending internal stud tapered at the lower end thereof and the upper surface of the arm having an opening therein complimentary to the tip of said stud and receiving said tip to effect a lock-type clamping of the arm relative to the upper end of the shaft, said clamping also employing a clamping ring surrounding the upper end portion of the shaft between the cap and upper surface of the arm, if desired, and also having transversly aligned notches in the lower surface of said ring disposed upon said arm to facilitate the clamping thereof relative to the rotatable shaft.

One further important object of the invention is to provide a muffle which is suitably aligned and provided with heating means that surround a central axial opening that is open at opposite ends and is adapted to receive a crucible which contains materials such as pellets or small ingots of metal or ceramic material, glass and the like which is to be melted within the muffle and the opposite ends of the opening of the muffle are adapted to be closed by closure members preferably having projections of limited dimension on the faces thereof nearest the ends of the muffle and respectively mounted adjacent opposite ends of the muffle upon elongated members which are pivotly mounted upon shaft means carried by the muffle in parallel relationship to the axis thereof and coaxial with each other, whereby the elongated members may be pivoted upon said shafts between closure positions over the ends of the muffle and positions in which they are removed therefrom to permit access to the interior of the muffle.

Ancillary to the foregoing object is another object of providing cam means on said shafts operable by manually engageable levers which initially effect limited axial movement of the closures relative to the ends of the muffle to first remove of the projections therefrom and then possibly either move the closures pivotly away from said opposite end or into engagement therewith, as required, the cams being actuated by the levers to achieve the axial movement of the closure members either toward or from the opposite ends of the muffle, as required.

One additional object of the invention is to provide an adjustable mounting for the casting ring cradle relative to the end of the transverse arm upon which it is mounted in order to accomodate casting rings of different diameters within reasonable limits, the adjustment means comprising a rotatable disc-like cam operable about a pivot in the arm and disposed in a slot in the shaft which actually supports the cradle for movement transversly with respect to said arm, the arrangement also including releasable position-maintaining mechanism.

Details of the foregoing objects and of the invention, as well as other objects thereof, are set forth in the following specifications and illustrated in the accompanying drawings comprising a part thereof.

DETAILED DESCRIPTION OF THE PREFERRED EMBODIMENT OF THE INVENTION

One of the objectives which gave rise to developing the present invention constituted the desire to provide a bench-type centrifugal casting furnace or machine which included structure by which substantial freedom from vibration is achieved and details of which are set forth below. Additional objectives also have been achieved as described hereinafter.

Figure 1:
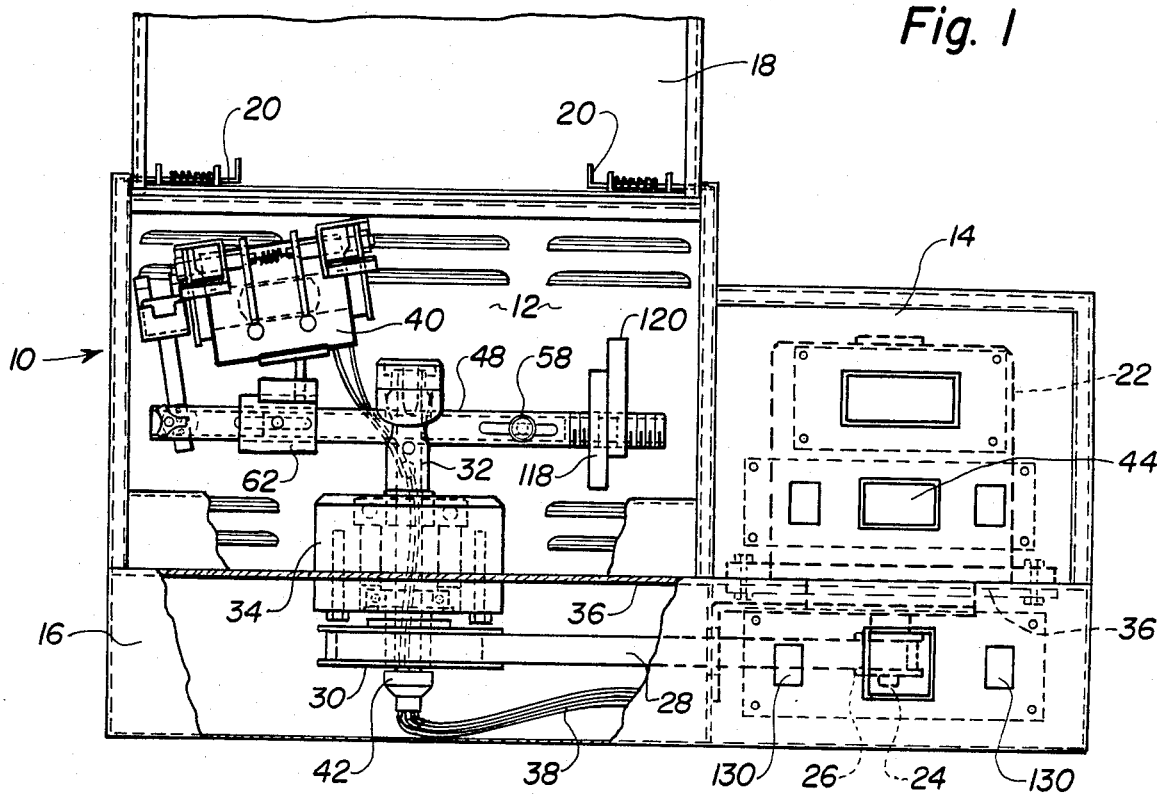
FIG. 1 is a front elevation of a centrifugal casting machine or furnace embodying the present invention, a portion of the front panel being broken away to illustrate details of the structure and a front cover also being shown fragmentarily in elevated position.
Figure 2:
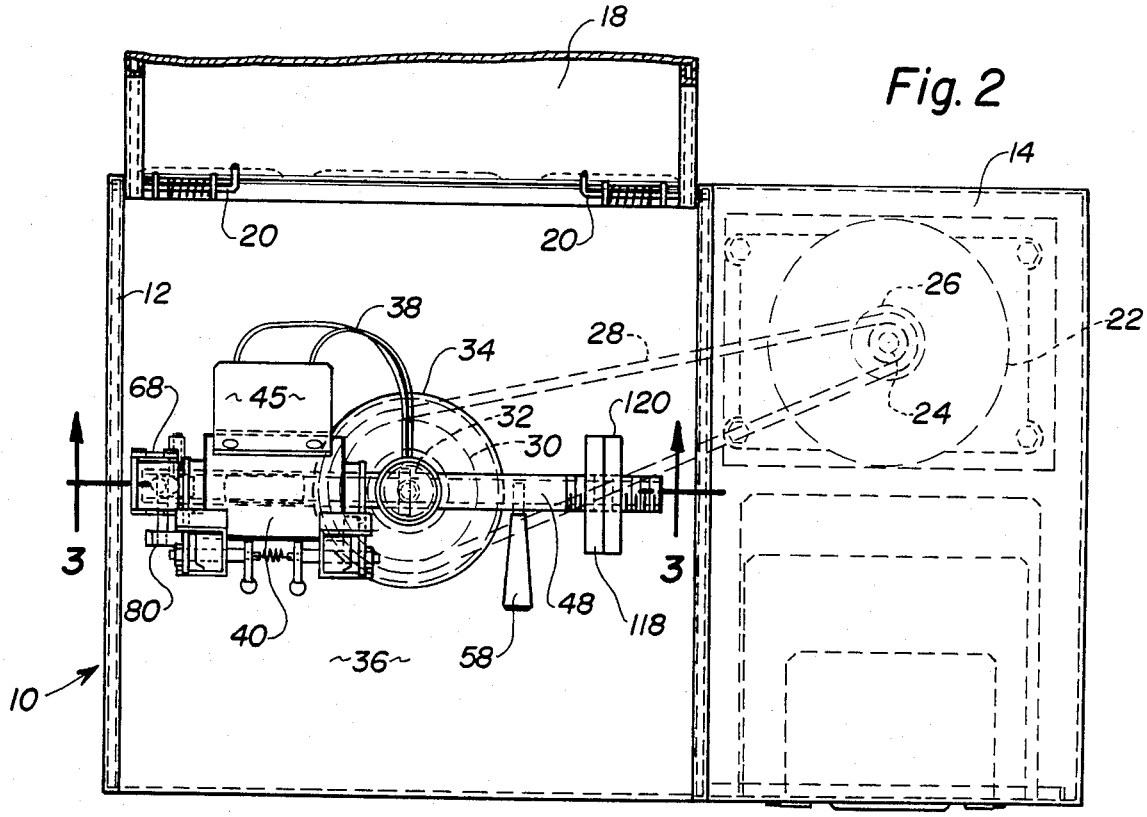
FIG. 2 is a plan view of the machine shown in FIG. 1 with the top cover raised and illustrated in fragmentary manner.

Referring to FIGS. 1 and 2 in particular, it will be seen that the invention includes a housing 10 which actually includes adjoining compartments 12 and 14, both of which commonly extend upward from a base frame 16. The compartment 12 also has a hinged cover 18 which is rendered removeable by providing retractable hinge pins 20. Preferably, though not illustrated, the hinged cover 18 is L-shaped in cross section to provide a top panel and at least a partial front panel, the latter extending down to the upper portion of base frame 16.

Compartment 14 includes an electric motor 22 of suitable horse power, the drive shaft 24 thereof depending therefrom as shown in FIG. 1 and including a sheave 26 around which an endless belt 28 extends and also encircles driven pulley or sheave 30 on the lower end of a rotatable shaft 32 which extends through a suitable rugged bearing unit 34 which is afixed to a horizontal panel 36 comprising the upper wall of base-frame 16. The panel 36 also extends into compartment 14 for purposes of having the motor 22 mounted thereon. A shield (not shown) protects the exposed end of rugged bearing unit 34 to prevent damage to the rugged bearing unit.

Figure 3:
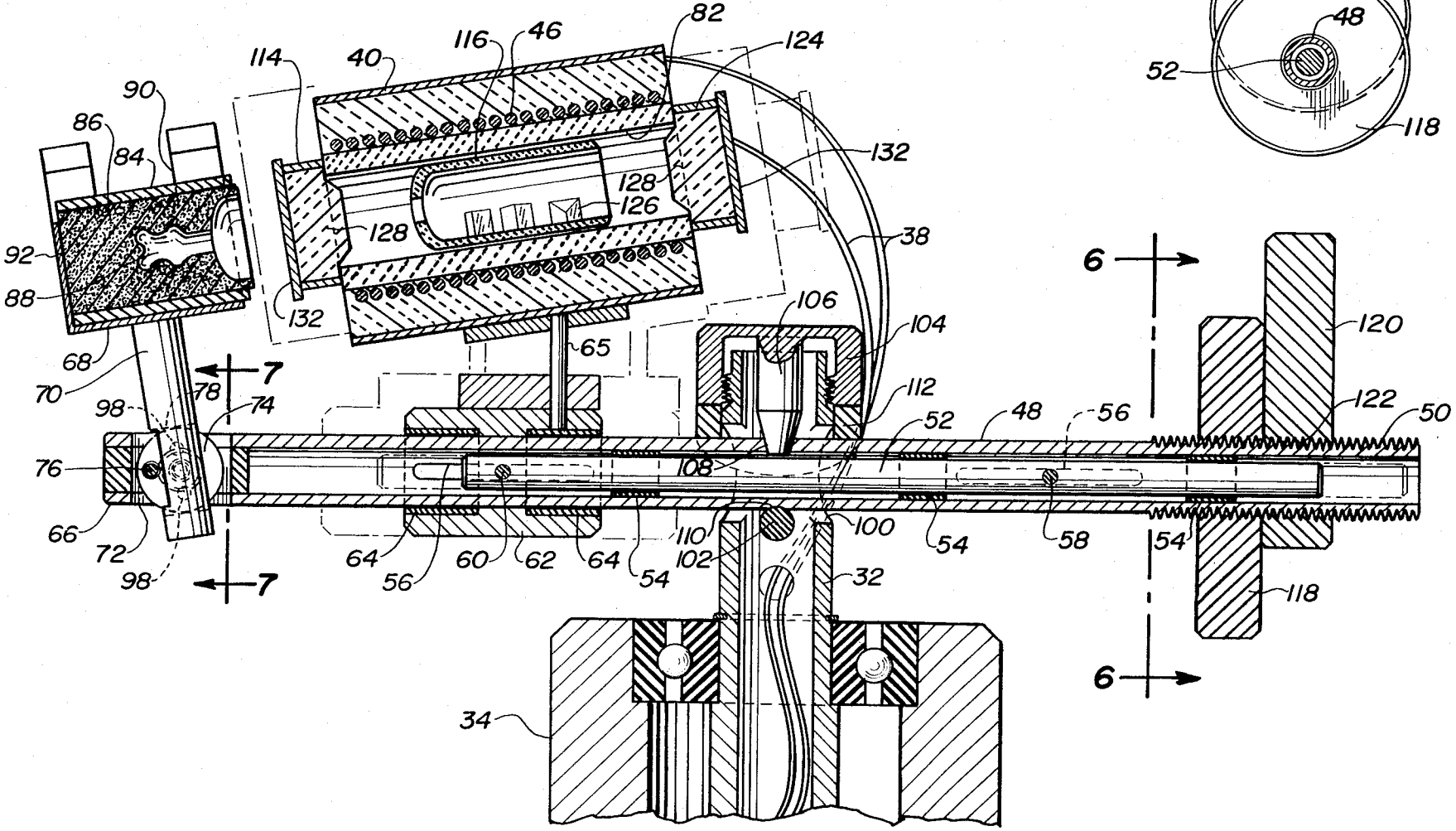
FIG. 3 is an enlarged vertical sectional view of the casting mechanism of the machine per se in which the mounting means is illustrated fragmentarily, said view being taken on the line 3—3 of FIG. 2.

The shaft 32 preferably is tubular, as best shown in FIG. 3, and accomodates electric conduits 38 which extend from a suitable source of electric power to a thermocoupled and the heating element within the furnace muffle 40, as shown in FIG. 3.

In reality, the electric conduit 38 comprises several pairs of wires, one pair extending between a temperature indicator 44 on the front panel of housing 14 and a thermocouple 45 which is encased within a housing attached to the shell of muffle 40 to respond to the actual temperatures. A second pair comprises a power lead to the heating wire 46 within the muffle 40 as shown in FIG. 3, the opposite end of said pair being connected to said aforementioned source of power. Both sets of wires are connected to and extend from a mercury contact slip ring 42 which is of such nature as to enable a temperature within the muffle 40 to be visually seen on the temperature indicator 44 while the muffle 40 is being centrifuged as described hereinafter. At least some of the subject manner of said electrical arrangement described above comprises the subject manner of a separate invention covered by a copending application assigned to the assignee of the invention of the present application.

Supported by the upper end of shaft 32 is a transverse arm 48 which preferably is tubular and one end 50 thereof is threaded externally. Slidably mounted within the arm 48 is a push rod 52 preferably supported within self-lubricating bearings 54 to facilitate the movement of said rod within the arm. The walls of the arm 48 also are provided with longitudinally spaced slots 56, the right-hand slot 56, as viewed in FIG. 3, accommodating a manually operable, laterally extending handle 58 and the left-hand slots 56 as viewed in FIG. 3, actually being an opposed pair thereof to receive a transverse pin 60 which extends therethrough and also through a support sleeve 62 and on end of the push rod 52. Preferably, the sleeve 62 includes self-lubricated bearings 64 to facilitate movement of the muffle 40 in opposite longitudinal directions upon the arm 48. Muffle 40 is secured to sleeve 62 by a vertical pin 65 which extends upward from sleeve 62 and the upper end is connected to the shell of muffle 40.

Figure 7:
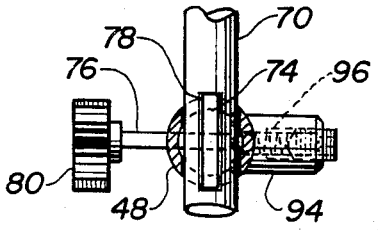
FIG. 7 is a fragmentary vertical elevation of the adjustable support for the casting ring cradle as seen on the line 7—7 of FIG. 3.

The opposite end 66 of arm 48 from the threaded end 50 thereof adjustably supports a casting ring cradle 68 which is fixed to the upper end of a shaft 70 that is substantially perpendicular to the arm 48 and said arm is provided with a suitable aperture, complimentary in shape to that of the shaft 70 in order to guide the same for such perpendicular movement. Also, said end of arm 48 is provided with a slot 72 within which rotatable cam member 74, and preferably a relatively thin disc, is moveable, said disc also being fixed to a transverse shaft 76 which extends through suitable bearing openings, not shown, in opposite sides of the arm 48. Shaft 70 also is formed with a narrow slot 78 which actually is coextensive with the slot 72, the length of slot 78 being equal to the diameter of the cam member 74. Said details are best shown in FIG. 7. The outer end of shaft 76 has a manually operated knob 80 fixed thereto.

As the shaft 76 is rotated in opposite directions, it will dispose the cradle 68 at different nearly horizontal axial positions relative to the axis of the central opening 82 in muffle 40 in order that casting rings 84 of different diameters may be rendered coaxial with the opening 82. Said rings are employed to contain suitable mold-forming material 86 such as a gypsum material or the equivalent within which a mold cavity 88 may be formed, such as by the lost wax process, and adapted to receive molten material when same has been melted within the muffle 40. Further, in the preferred operation of the molding procedure in which the present invention mechanism is adapted, the casting rings 84 are preheated in a separate furnace so that there is no appreciable differential in temperatures between the cavity 88 and that of the molten material.

To facilitate mounting the white hot casting ring 84 within cradle 68, said cradle is substantially U-shaped in cross section and the opposite sidewalls thereof are provided with slots 90 to receive and accomodate the ends of tongs which are used to handle the casting rings and the molds disposed therein. Also to facilitate positioning the casting rings in the cradle 68, the outermost end thereof is provided with a fixed end wall 92. To maintain the alignment position of the cradle 68 with the central opening 82 of muffle 40, the arm 48 is provided at one side with a boss 94 within which a spring-loaded detent 96 is mounted for projection of the inner end thereof into one of a series of similar depressions 98, see FIGS. 3 and 7, formed in one side of the shaft 70, and to simplify the system, only a limited number of the depressions 98 are formed respectively according to a limited number of diameters of said casting rings to be positioned in the cradle 68.

Arm 48 is supported within an opening 100 in shaft 32 which is larger than the diameter of the arm 48, at least in the vertical direction and, if desired, may be circular. Extending transversely through the upper end portion of shaft 32 is a pin 102 of which at least the upper portion extends above the lower surface of the opening 100 in order that the same may serve as a fulcrum used incident to statically balancing the arm 48. This is possible by virtue of the greater vertical dimension of the opening 100 than the vertical dimension of the arm 48 and the location of the pin 102 in said opening such as can be visualized when the cup-shaped cap 104 is relaxed from the clamping position illustrated in FIG. 3 and such relaxation also removes the tapered terminal end of the interior stud 106 that is affixed within the cap 104 and is received within the complimentary opening 108 in arm 48.

To firmly clamp the arm 48 in the position shown in FIG. 3 for example, after the arm has been balanced in a manner described hereinafter, the cap 104 is threaded downwardly to laterally move the tapered end thereof into the complementary opening 108 in arm 48 and also force the lower surface of arm 48 into firm abutment with transverse pin 102 which, incidentally, preferably is received within a shallow notch 110 in the lower surface of arm 48 and at least somewhat serves as a safety means to prevent any appreciable longitudinal movement of the arm 48 in the event the cap 104 has not been screwed tightly into clamping position. Further to aid in the clamping of the arm with respect to shaft 32, a clamping ring 112 is disclosed, the top of which is abutted by the lower face of the cap 104 and the lower surface of ring 112 preferably is oppositely notched to receive the upper surface of the arm 48.

Figure 5:
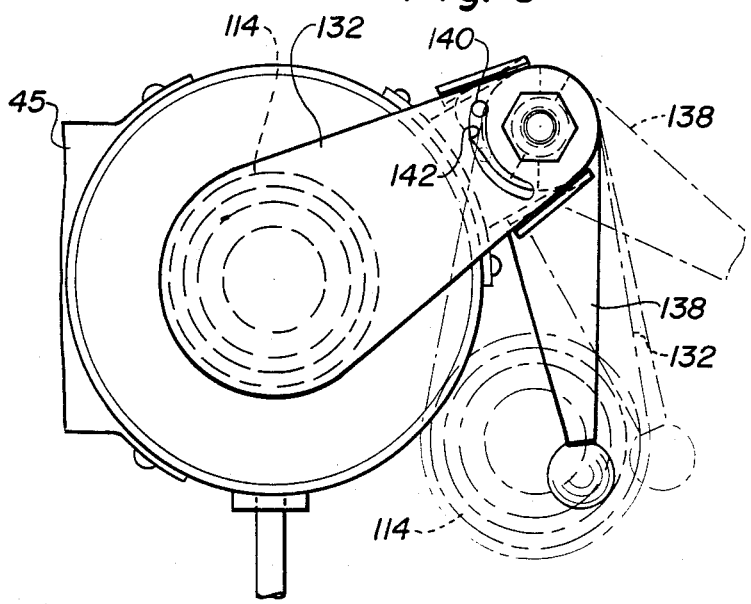
FIG. 5 is an end view of the muffle shown in FIG. 4, one of the closure means being shown in the closed position in full lines and, in phantom, being shown in fully opened position.

When it is desired to statically and dynamically balance the opposite ends of the arm 48 with respect to each other, the muffle 40 is moved into abutment with the cradle 68 but only after first moving the rear closure 114 to the inoperative phantom position shown in FIG. 5. This is done by means described hereinafter but it will be understood that the outermost end of the muffle 40 will firmly abut the mouth of the cavity 88 in the mold 86 disposed in the casting ring 84 and, to be even more precise, the muffle preferably is charged with a crucible 116 shown within the opening 82 in the muffle and that is substantially the position it will occupy while the crucible is being heated to melting temperature. When centrifugal casting occurs, the nose of the crucible will be centrifugally forced against the inlet of the mold cavity 88.

Figure 6:
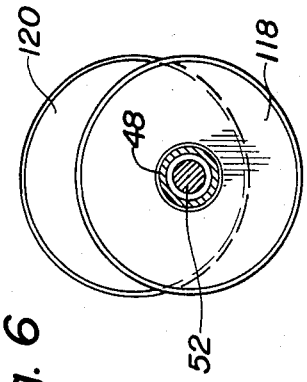
FIG. 6 is a sectional elevation taken on the line 6—6 of FIG. 3.

Balancing is achieved by means preferably comprising a mass of weight mounted on the threaded end 50 of arm 48 and longitudinally positioned thereon so as to statically balance of the weight of the muffle 40 and cradle 68 when in the abutting position described above and such balancing is achieved by relieving the cap 104 and preferably even removing the clamping ring 112 and also removing the tapered end of the stud 106 from the opening 108 in arm 48, whereby the arm 48 can teeter about the fulcrum pin 102. It is a relatively simple operation to statically balance the ends of the arm 48 with respect to each other by threadably moving the weights 118 and 120 on the shaft until balance is achieved. However, to dynamically balance the opposite ends in static mode, it is essential that the centers of gravity of the weights on opposite ends of arm are substantially in a common horizontal plane parallel to the axis of arm 38 and this is achieved by employing, for example, a metal weight 118 which is centrally threaded and a similar weight 120 which is provided with an offset bore 122 that preferably is substantially off center as readily can be visualized from FIGS. 3 and 6 and, when the arm is dynamically balanced the greater mass of the weight 120 is disposed uppermost so as to counterbalance in a vertical direction the center of gravity of the mass of the elements on the opposite end of arm 48 which are positioned aboved the axis of said arm. When such dynamic balancing is not at least reasonably achieved, there is a tendency for the casting machine to vibrate and tend to generate circular motions at opposite ends of the arm that are out of phase with each other. Therefore, it is an important object of this invention to eliminate such vibration as far as possible and it has been found that the weight arrangement illustrated in FIGS. 3 and 6 is at least one satisfactory means for achieving it.

The dynamic balancing necessitates initially statically balancing opposite ends of the arm 48 and then operating the machine to determine whether static balancing has been achieved. If it is found not to be achieved to a desired extent, then further adjustment of the weights 118 and 120 is undertaken until the greatest possible elimination of vibration is achieved. This may require a number of trial operations and rebalancing of the arm. Another advantage of employing the weights 118 and 120 is that when final adjustment is achieved, the center of gravity of the assembled weights is uppermost and said weights may be coengaged in lock-nut manner to retain the desired adjustment and, having achieved such static as well as dynamic balancing, continual operation of the casting machine usually requires no further adjustment. A safty pin may be used at the end of the transverse arm 48 to prevent weights 118 and 120 from flying off if the weights should become dislodged.

Figure 4:
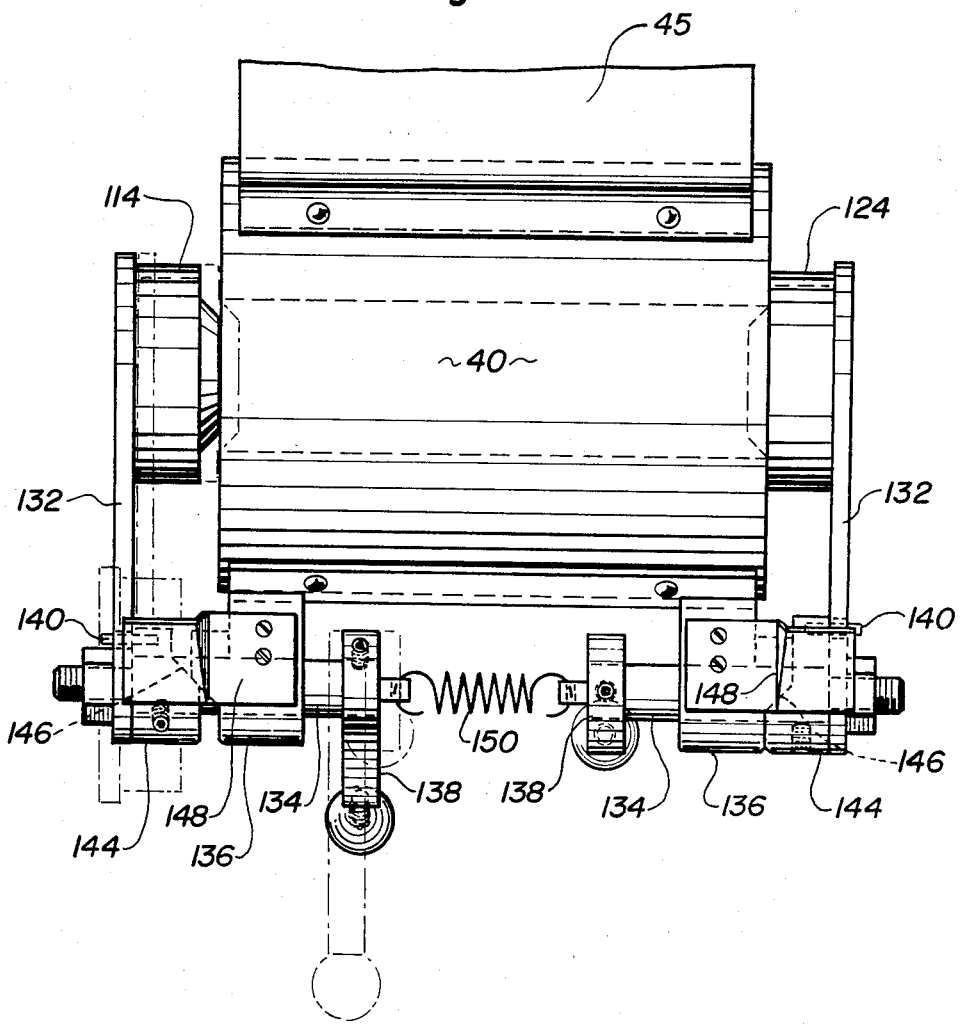
FIG. 4 is an enlarged plan view of the muffle structure of the casting machine illustrated in FIGS. 1-3 and showing the closure members for the opposite ends of the muffle respectively in fully closed and partially opened positions and one of the actuating cam means being illustrated in full lines in the partially open position and, in phantom, being shown in closed position.

As shown especially in FIGS. 3 and 4, the muffle 40 has a rear closure 114 and also a forward closure 124. When a casting is to be undertaken, a crucible containing metal, glass, or ceramic material such as represented by the ingot 126 within the crucible 116 which is placed on the interior of muffle 40 and both of the closures 114 and 124 are disposed in sealing relationship as illustrated, for example, in FIG. 3. It also will be seen that each closure comprises a metallic shell within which heat insulating plug-like projection 128 is formed, each of them having a nose extending partially into the central opening 82 of the muffle to effect firm sealing of the contents. Suitable switch means of conventional type are included, for example, in compartment 14 and provided with switch buttons 130, for example, for various purposes, including operating the motor 22 and directing current to the heater 46 in the muffle. After disposing the crucible 116 with its contents in the muffle 40, current is introduced to the heating member 46 and is continued until the contents of the crucible become molten. At that time, a pre-heated casting ring 84 with its mold configuration is placed in the cradle 68, the rear closure 114 is opened quickly and handle 58 is operated to move the muffle 40 rearwardly into abutment of the open rear end thereof with the mold 86 and, if desired, the closure 124 may be opened to effect pushing the crucible 116 to the rear end of the central opening of the muffle so as to abut the inlet end of the mold cavity 88, all of which is accomplished as quickly as possible. Then the motor 22 is activated to commence centrifugal casting of the material into the mold cavity 88. Such centrifugal casting is continued in accordance with known practice in order to insure faithful casting of the material in the cavity 88 and removal of any occluded air or otherwise which might result in a misfigured casting. At the conclusion of such casting operation, the crucible is moved toward the shaft 32 and the hot casting ring and molded item are removed from the cradle 68 and suitably processed by conventional means to remove the cast object from the mold-forming material.

Operation of the closures 114 and 124 is performed by mechanism which specifically has been designed to take into consideration the projecting noses on the ceramic plug-like members 128 in the closures 114 and 124. The required operation of the closures includes moving the same from the full line illustration thereof in FIG. 5, wherein the plug-like members are disposed with the noses within the cavity of the muffle, and the phantom position shown thereof in FIG. 5 in which one or both ends of the central cavity of the muffle are fully exposed for either receiving or removing the crucible 116 or otherwise. Especially as shown in FIGS. 4 and 5, the closures per se are mounted on one end of elongated members 132 that are pivotly supported respectively on the outer ends of a pair coaxially aligned shafts 134 which are mounted for limited axial movement with respect to the bearings 136 which are affixed to one side of the housing of muffle 40.

Attached to the inner end of each of the shafts 134 is an operating handle 138 which may have a knob on the outer end thereof if desired. The members 132 each have a bearing hole in the end thereof attached to the shaft 134 and are freely suspended from such shaft so that, when desired, they may fall by gravity from the full line position shown in FIG. 5 to the phantom position shown therein and thereby render one or both ends of the muffle open. Affixed to each of said members adjacent to the pivot thereof is a pin 140 which extends into an arcuate slot 142 in each member 132. The pin is fixed to a cam member 144 which is provided with an angular cam face 146 that is engageable with a suitable surface on fixed member 148 that is attached, for example, to bearing member 136. The cam member 144 may be secured to the shaft 134 for rotation therewith by any suitable means such as the set of screws clearly shown in FIG. 4.

Referring to FIG. 4 at the right hand end, it will be seen that the closure member 124 is in full sealing relationship with the forward end of the muffle 40 and the projection thereon extends into the central opening of the muffle as shown in dotted lines. When it is desired to open that end of the muffle, the handle 138 interconnected to the closure 124 by elongated member 132 is moved in a direction initially to cause the cam face 146 to engage fixed member 148 at the right hand end of FIG. 4 and thereby axially move the closure member 124 so as to be disposed in a position similar to that illustrated at the left hand end of FIG. 4 with respect to closure member 114. When this has been accomplished, continued movement of the handle toward the uppermost phantom position shown in FIG. 5 will permit the closure and elongated member 132 thereon to assume the phantom position by gravity and the innermost end of cam member 144 then will rest against fixed member 148 and maintain the open position.

Conversely, when it is desired to close the ends of the muffle 40, the handle 138 is moved from said uppermost phantom position thereof shown in FIG. 5, for example, and at the initial part of such movement causes the cam face 146 to axially move the pivoted end of member 132 on closure 114 to the full line position shown in FIG. 4 and continued movement will dispose the pin 140 on the cam member against the upper end of arcuate slot 142, as shown in FIG. 5, and thus positively effect clockwise movement of the elongated member 132 and closure member 114 to the sealing position and when this occurs, cam face 146 is in an idle position with respect to the fixed member 148 at the left side of FIG. 4 and tension spring 150, which extends between the adjacent ends of the shaft 134 functions to firmly position the projecting inner surface of the closure member 114 within the end of the muffle it is to seal. A ceramic tube (not shown) is applied over spring 150 to insulate the spring from heat and the spring is attached to the doors 114 and 124 via a swivel (not shown) to prevent twisting.

Looking at FIG. 1, it can be appreciated that the overall height of the centrifugal casting furnace of the present invention has been minimized while retaining excelent control parameters. The horizontally disposed casting arm 48 is horizontally disposed and carried at the upper end of the vertically disposed rotateable shaft 32. The driving motor 22 that powers the shaft 32 is mounted horizontally displaced and remote from the shaft 32 but on substantially the same horizontal level as the shaft 32. By this it is meant that the motor 22 and the shaft 32 are at substantially the same height or distance from the bottom of the housing 10. The motor 22 is connected to the shaft 32 positively by the belt 28 which is toothed to provide a positive driving connection therebetween.

From the foregoing, it will be seen that the present invention provides a relatively simple yet highly effective centrifugal casting furnace or machine capable of easy operation and especially designed to be relatively free of vibration so as to be operated as a bench casting machine or furnace in view of the structure cited above. This is primarily due to the particular arrangement of counterweights and the adjustment thereof to effect not only static but likewise dynamic balancing of the arm 48 in the static mode.

In one prefered operation sequence, of casting a ceramic dental prosthesis part, i.e. a dental crown, the muffle 40 is preheated to 1100° C. A glass slug or ingot 126 is loaded into cruciable 116. Muffle door 124 is opened and the loaded cruciable is inserted into the muffle and the door is closed. The loaded muffle is then raised to a temperature of 1360° C. and this temperature is held typically for 6 minutes. The heating is by electrically heating the muffle by power supplied via the electrical conduits 38, which traverse the hollow shaft 32, the mercury wetted slip ring 42 and the electrical input conduits 38. This incubating or melting phase is preferably carried out with the crucible stationary, the shaft 32 being stationary.

The casting ring 84 which has been preheated in an oven (not shown) to 1650° F. is then positioned in the casting ring cradle 68. The door 114 is opened and the muffle 40 is moved into abutment with the casting ring 84. Next the cruciable 116 is manually pushed to seat against the mold-forming material 86.

Then the hinged cover 18 of the casting machine is closed and the motor 22 is powered to about 1790 rpm (motor rated at 1725 rpm) and rotates the shaft 32 at about 500 rpm via the endless belt 28. The belt 28 is preferable a toothed belt to assure accurate revolutions per minute corresponding to the motor speed and the sprocket ratios. The motor 22 is a constant speed motor. The shaft 32 is typically spun or rotated at a constant sustained speed for 4.5 minutes. The hinged cover 18 is then opened. At the end of the constant speed operation the rotation is terminated by internal frictional characteristics to stop promptly or abruptly, within 4 to 20 seconds, preferably 4 to 10 seconds and most preferably about 6 seconds. The casting ring and cruciable are then removed. The casting ring 84 and the cast material are set aside and allowed to cool at ambient. The door 114 is closed and the upper door 124 is opened to receive a new loaded cruciable and the cycle is repeated.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

It is claimed:

1. A centrifugal casting furnace comprising in combination, a. a vertical rotatable shaft supported on a base, b. a transverse arm supported by the upper end of said shaft, c. an electrically heated muffle supported upon one end of said arm in elevated relationship to the axis thereof and having means to receive material to be cast.

d. power means connected in driving relationship to said shaft to rotate it at a predetermined speed, and e. counterweight means vertically and longitudinally adjustably connected to the opposite end of said arm and comprising a pair of circular flat weights and said opposite end of said arm being threaded, one of said weights having a substantially central threaded opening and the other weight having a threaded opening substantially offset from the center thereof, said weights being threadably movable upon said arm to positions to counterbalance said weights and muffle statically relative to said shaft and effect a lock-nut arrangement with each other and the main mass of said offset weight being disposed uppermost relative to the axis of said arm to dynamically balance said arm to effect freedom from vibrations thereof when said arm is rotated.

2. The furnace according to claim 1 further characterized by said arm being tubular and a push rod being enclosed therein, said tublar arm having axially spaced longitudinal slots in the walls thereof respectively to accomodate a connection between said muffle and a handle.

3. The furnace according to claim 1 further characterized by a cradle being supported by a shaft mounted transversely to said arm and extending through a transverse guide opening therein, and cam means movably carried by said arm and engaging said shaft to move the same suitably to position said cradle selectively at vertically spaced positions respectively to accommodate casting rings of different diameters.

4. The furnace according to claim 3 further characterized by said cam means comprising an eccentric disc extending within coinciding slots in said arm and shaft, and further including a rod extending through and fixed within an offset aperture in said disc and said rod being rotatably supported within bearing openings in said arm at opposite sides of the slot in said arm, and releasable coengageable position-maintaining means respectively on said arm and cam disc, and a manually operable knob on one end of said rod for actuation of said cam disc.

5. The furnace according to claim 1 further characterized by the outermost end of said muffle having a discharge opening, and said furnace further including a closure having a plug-like projections of limited length adapted to be received within said discharge opening, and means supporting said closure for movement pivotably about an axis laterally offset from a parallel to the axis of said muffle and movable toward and from said discharge opening within a plane between said end of said muffle and said cradle and transverse to the axis of said muffle and said closure also being movable axially to dispose said projection within said opening to seal it.

6. The furnace according to claim 5 further characterized by said muffle being open at both ends and including closures supported respectively adjacent both ends of said muffle, and said plug-like projections being shaped to be inserted respectively a limited distance into the open ends of said muffle to effect sealing the interior of the muffle, means supporting said closures for axial and pivotal movement relative to an axis parallel to and laterally offset from the axis of said muffle, and further including means operable to effect such movement of said closures comprising a pair of manually operable levers connected respectively to one end of coaxially movable shafts respectively comprising said pivotal supports for said closures, a cam on each shaft abutting a fixed member on the muffle and operable when rotated initially in one direction to move said shafts axially away from said ends of said muffle to permit access to the interior thereof and when said levers are moved in the opposite direction to first move the closures in line with the end of the muffle and then axially move the projections into the muffle.

7. The furnace according to claim 6 further characterized by said levers being fixed to the ends of said coaxial shafts which are nearest each other, and further including tension spring means extending between and connected at the ends thereof respectively to said nearest ends of said shafts and operable to effect inward axial movement of said closures and the projection thereon when said levers are moved in a direction as aforesaid to permit inward movement of said closures relative to the outer ends of said muffle.

8. The furnace according to claim 7 further characterized by said closures being mounted upon elongated members connected at one end thereto and the opposite ends being mounted pivotally respectively upon the outer ends of said coaxially movable shafts, and said elongated members each having an acruate slot therein and said cams each having a pin movable in said slots, whereby when a selected lever is moved in one direction to move a closure rotatably in sealing relation to one outer end of said muffle initial movement of the lever causes the pin on the cam of said lever to move to one end of the slot in the member to effect pivotal movement of said member to align the closure thereon in axial alignment with an opening in the selected end of the muffle and said cam then is released from said fixed member on the muffle to permit axial movement of said shaft and closure by said spring and thereby dispose the projection on said closure in sealing relation with said one end of said muffle.

9. The furnace according to claim 1 in which said shaft is tubular and has a transverse opening in the upper end of larger diameter than said arm and through which said arm extends, a transverse pin extending through said shaft partially above the lower surface of said transverse opening, said arm having a notch in the lower surface thereof seated upon said pin for static balancing of said arm by adjustment of said counterweights thereon, and a clamping cap threaded upon the upper end of said shaft and having a lower rim clampingly interengageable with the upper surface of said arm to clamp the arm firmly upon said transverse pin after static balancing has been completed.

10. The furnace according to claim 9 in which said cap is cup-shaped and has a depending internal stud tapered at the lower end thereof and the upper surface of said arm has an opening therein complementary to the tip of said stud and receiving said tip to effect lock type clamping of said arm as aforesaid.

11. The furnace according to claim 10 further including a clamping ring surrounding the upper end portion of said shaft between said cap and upper surface of said arm and having transversely aligned notches in the lower surface and disposed upon said arm to facilitate the clamping thereof relative to said rotatable shaft.

* * * * *